US012575601B2

(12) United States Patent
Donato et al.

(10) Patent No.: US 12,575,601 B2
(45) Date of Patent: Mar. 17, 2026

(54) REDUCTION OF AMINES AND NITROSAMINES IN CIGARETTE SMOKE VAPORS THROUGH A FILTER FUNCTIONALIZED WITH OLIVE TREE POLYPHENOLS

(71) Applicant: MAGI'S LAB SRL, Rovereto (IT)

(72) Inventors: Kevin Donato, Brescia (IT); Matteo Bertelli, Brescia (IT); Simone Cristoni, Milan (IT); Kristjana Dhuli, Brescia (IT); Maria Chiara Medori, Brescia (IT); Jurgen Kaftalli, Brescia (IT); Gabriele Bonetti, San Felice del Benaco (IT); Cecilia Micheletti, Brescia (IT)

(73) Assignee: MAGI'S LAB SRL, Roverto (IT)

( * ) Notice: Subject to any disclaimer, the term of this patent is extended or adjusted under 35 U.S.C. 154(b) by 431 days.

(21) Appl. No.: 18/125,146

(22) Filed: Mar. 23, 2023

(65) Prior Publication Data

US 2024/0315323 A1 Sep. 26, 2024

(51) Int. Cl.
*A24D 3/14* (2006.01)
*A24D 3/08* (2006.01)

(52) U.S. Cl.
CPC *A24D 3/14* (2013.01); *A24D 3/08* (2013.01)

(58) Field of Classification Search
None
See application file for complete search history.

(56) References Cited

U.S. PATENT DOCUMENTS 4,507,256 A * 3/1985 Jackson, Jr. ..... B29C 44/50 264/45.5
2004/0200490 A1* 10/2004 Inagaki ..... A24D 3/163 131/342

FOREIGN PATENT DOCUMENTS

| | | | |
|---|---|---|---|
| CN | 106490680 | A | 3/2017 |
| KR | 20060023107 | A | 3/2006 |
| KR | 20130019738 | A | 2/2013 |

OTHER PUBLICATIONS

Martinez et al., Hydroxytyrosol: Health Benefits and Use as Functional Ingredient in Meat,2018, open access article under terms of the Creative Commons Attribution license, [online],retr. from Internet, [retr. Jul. 23, 2025], URL:https://pmc.ncbi.nlm.nih.gov/articles/PMC5874578/#sec4-medicines-05-00013. (Year: 2018).*

* cited by examiner

*Primary Examiner* — Dennis R Cordray
(74) *Attorney, Agent, or Firm* — Volpe Koenig

(57) ABSTRACT

The traditional filters used in cigarettes are found to be ineffective in trapping the toxic chemical compounds which cigarette produces during combustion. The current invention aims to provide systems and methods (or to a universal filter) to reduce amines and nitrosamines in cigarette smoke vapors through a filter functionalized with olive tree polyphenols. Amines and Nitrosamines are highly toxic chemicals in the smoke and aerosol of a combusted cigarette. Olive polyphenols are able to trap amines and nitrosamines by establishing weak and strong interactions with these compounds by trapping these compounds in the filter.

7 Claims, 11 Drawing Sheets

Table 1. Most significant molecules in which there was diminution of the signal acquired from smoke and aerosols in the PT filter compared with the NC filter.

| Molecules | m/z | Ion Detected | Spectral Intensities NC (AU) | Spectral Intensities PT (AU) |
|---|---|---|---|---|
| Formaldehyde | 67 | $[M+H+2H_2O]^+$ | 1154 | 342 |
| Acetone | 59 | $[M+H]^+$ | 1254 | 331 |
| Acrolein | 75 | $[M+H+H_2O]^+$ | 1698 | 478 |
| Aniline | 94 | $[M+H]^+$ | 2144 | 564 |
| O-Toluidine | 108 | $[M+H]^+$ | 1876 | 531 |
| 2,4,6 – Trimethylaniline | 136 | $[M+H]^+$ | 1874 | 598 |
| Anisidine | 124 | $[M+H]^+$ | 1977 | 502 |
| N'-nitrosonornicotine | 178 | $[M+H]^+$ | 2030 | 1125 |

Comparative analysis of plots

Figure. Spectra of the detected compounds.

In the first spectrum of each molecule:

- The black spectrum refers to the compounds detected in the cigarette smoke with NC filter.
- The red spectrum refers to the compounds detected in the cigarette smoke with PT filter.

FIG. 3a-h a) Formaldehyde b) Acetone c) Acrolein d) Aniline e) O-Toluidine f) 2,4,6-Trimethylaniline g) Anisidine h) N'-nitrosonornicotine

REDUCTION OF AMINES AND NITROSAMINES IN CIGARETTE SMOKE VAPORS THROUGH A FILTER FUNCTIONALIZED WITH OLIVE TREE POLYPHENOLS

COPYRIGHT NOTICE

A portion of this patent document's disclosure contains material subject to copyright protection. The copyright owner has no objection to the facsimile reproduction by anyone of the patent disclosure, as it appears in the Patent and Trademark Office patent files or records, but otherwise reserves all copyright rights.

BACKGROUND

Field of the Invention

This invention relates to an advancement in the smoking industry. It particularly relates to systems and methods to reduce amines and nitrosamines in cigarette smoke vapors through a filter functionalized with olive tree polyphenols.

Description of the Related Art

Cigarettes include tobacco rods or columns, which, when burned, produce particulate and a vapor phase. About 70 years ago, filters began to be attached to the end of the tobacco column. Among other things, the filter removed various smoke components. Filters made from filamentary or fibrous material, such as cellulose acetate tow or paper, remove the particulate phase of tobacco smoke by mechanical means. However, the fibrous materials are ineffective at eliminating volatile constituents, such as aldehydes, hydrogen cyanide, amines, nitrosamines and sulfides found in the vapor phase. Typically, an adsorbent or absorbent is combined with the fibrous material to improve the removal of the vapor phase components. For example, cigarette filters include activated carbon and porous minerals such as meerschaum, silica gel, cation-exchange, and anion-exchange resins.

Charcoal has a high specific surface area and is a relatively strong adsorbent for vapor-phase constituents of tobacco smoke. When coated with metallic oxides, charcoal is particularly effective in removing acidic gases. Silica gels are generally regarded as weakly retentive adsorbents for vapor-phase constituents of tobacco smoke. Although silica gel readily adsorbs aldehydes and hydrogen cyanide, the constituents also readily desorb from the silica gel. Cation exchange resins have been proposed for nicotine removal. Anion exchange resins have been offered to remove smoke acids, but strongly basic anion exchangers do not affect smoke vapor phase aldehydes. Weakly basic anion-exchange resins of a porous structure are suitable for eliminating smoke acids and aldehydes, but their efficiency diminishes during smoking, as does that of carbon and porous minerals.

Two or more adsorbents can be used in combination with cigarette filters. For example, U.S. Pat. No. 2,815,760 describes using an ion exchange material with materials that "chemically react with the smoke's harmful, non-alkaline and nonacid components to form non-volatile compounds, thus retaining the latter to the filter." However, the earlier additives have not yielded satisfactory selective removal of smoke-phase components such as amines, nitrosamines, aldehydes, particularly acetaldehyde, and acrolein. U.S. Pat. No. 4,300,577 describes using a weakly retentive absorbent for vapor-phase constituents intermingled with a second component having mainly primary amino functional groups for removing vapor-phase constituents, including aldehydes and hydrogen cyanide from tobacco smoke. However, the filter of the '577 patent has not been shown to demonstrate adequate consumer acceptance or commercial viability and is silica-based; and no action against amines or nitrosamines is taken.

Similarly, looking at advancements proposed by multiple manufacturers shows continuous effort in a similar domain. As described in (Pauly et al., 2009), Parliament (Benson and Hedges) was a cigarette brand introduced as a premium-priced cigarette filter in 1931 which consisted of a cigarette that was introduced as a premium-priced filtered cigarette. Viceroy originated in 1936 and was the first cork-tipped filtered cigarette in the world (https://tobaccotactics.org). During that time, cigarettes were generally around 70 mm, unfiltered, and all brands were similar (Kozlowski et al., 2000). Such cork-tipped cigarettes started to be commercialized with cellulose acetate fiber in 1953. In 1940, filters were promoted as an item of novelty to attract women smokers (Browne CL, 1990). In 1954, Lorillard introduced Kent with a 'Micronite Filter,' which offered the most significant protection against cigarette smoke in human health history (Borio G, 2009). Again, in the 1970s, the filters were made with vents that permitted the air to be introduced into mainstream smoke (O'Connor et al., 2008). Then in around the 1973s, scientists in Switzerland reported the factors causing the smoke constituents to undergo retention with and without using activated carbon. By the 1980s, almost all cigarettes sold worldwide had filters (93% market share, non-filter cigarettes, 7% market share) (Pauly et al., 2009). Also, in the same year, studies showed that smokers of low-yield, ventilated-filter ('less hazardous) cigarettes sometimes successfully defeated the purpose of the smoke-dilution holes by occluding the holes (Kozlowski et al., 1980). In 2003, carbon filters were developed for the cigarette to provide potentially less exposure to the carcinogens of conventional cigarettes, but they failed to get significant customers and were stopped from being used (Laugesen et al., 2006). For making cigarette filters safer, various steps have been put forward; anti-toxic flavoring agents can be added to filters, as described in (Bellamah et al., 2008), and studies for the determination of components of tobacco used in cigarettes have been conducted (Leanderson et al., 1997; Qamar and Sultana, 2011; Yang, 1958; Cuzin et al., 1965; Shifflett et al., 2017; Mi et al., 2015), and standard filters using compounds like polyphenols to remove contaminants.

Despite the fact that many perceptions that filters are highly defensive against toxic compounds of smoke like nitrosamines, research has shown that cigarette filters do not offer much health benefit and filtered cigarettes are not less harmful than unfiltered cigarettes, whether for smokers or passive smokers (https://tobaccotactics.org). Potential solutions have been explored to make toxic compounds that emit during filtration be removed. Thus far, the main approaches have focused on treating filters contaminated with toxicants as described by ISO mainstream smoke that yields of 43 toxicants that were measured from cigarettes containing treated tobaccos; lower yields of tar, nicotine, carbon monoxide (16-20%), acrylonitrile, ammonia, aromatic amines, pyridine, quinoline, and hydrogen cyanide (33-51%), tobacco-specific nitrosamines (25-32%); phenolics (24-56%), benzene (16%), toluene (25%) and cadmium (34%) with increased yields of formaldehyde (49%) and isoprene (17%) (Liu et al., 2011). The research using currently available filters to reduce toxicants has focused on modifying filters to improve the filtering capacity and recycle cigarette butts and the chemicals trapped in them during filtration (Torkashvand et al., 2022). Developing the safest, most reliable, and reusable material for filtering the toxic compounds from smoke generated during combustion remains challenging. This can decrease the health impacts caused by this large industry producing cigarettes that are still ineffective in providing complete security to smokers against toxic compounds through filters. Studies and reports suggest that polyphenols help to significantly reduce cytotoxicity, which defines a protective role in lung epithelium (Qamar and Sultana, 2011).

E-cigarettes have revolutionized the consumption process of cigarettes. They have been consumed for about a decade. Still, it has resulted in a manifestation period of two or more decades for the generation of numerous smoking-related symptoms and health effects (Balfour et. al., 2021, Lucchiari et al., 2020, Roditis et al., 2015, Bozier et al., 2020, Cohen et al., 2022, Begh and Aveyyard, 2020). The steps taken to examine the long-term effects of vaping on public health have been taken too early. Studies have compared the genotoxic and cytotoxic capacity of mainstream smoke obtained from non-filter 2R4F, CA-filter 2R4F, and carbon-filter 2R4F cigarettes were determined using the assays: bacterial mutagenic assay and a neutral red cytotoxicity assay (Shin et al., 2009). Epidemiological studies have shown that the long-term consumption of polyphenols offers protective effects against cancer, cardiovascular diseases, diabetes, osteoporosis, and neurogenerative diseases; strongly suggest that long-tenn consumption of diets (fruits, vegetables, tea, and coffee) rich in polyphenols offer protective effects against the development of cancer, cardiovascular diseases, diabetes, osteoporosis, and neurodegenerative diseases. (Rudrapal et al., 2022; Castelli et al., 1981; Teo et al., 2006; Herxheimer et al., 1967; Talcott et al., 1989; Auerbach et al., 1979; Cryer et al., 1976). The observations in research suggest that inhalation of tobacco containing nicotine reduces vascular PGL production, causing cardiovascular disease (Nadler et al., 1983).

The current invention aims to advance in a similar domain by providing an alternative approach in which a filter functionalized with olive tree polyphenols it is proposed, in which the one most present is Hydroxytyrosol, which can be extracted from the leaves or the fruit of olives. The filter that is the subject of this invention is designed to reduce the amines and nitrosamines that are generated during cigarette combustion, because olive tree polyphenols can react to form strong and weak interactions with these compounds.

None of the previous inventions and patents, taken either singly or in combination, is seen to describe the instant invention as claimed. Hence, the inventor of the present invention proposes to resolve and surmount existent technical difficulties to eliminate the shortcomings mentioned earlier in the prior art.

SUMMARY

In light of the disadvantages of the prior art, the following summary is provided to facilitate an understanding of some of the innovative features unique to the present invention and is not intended to be a complete description. A full appreciation of the various aspects of the invention can be gained by taking the entire specification, claims, drawings, and abstract as a whole.

The primary desirable object of the present invention is to provide a novel and improved approach toward the functionalization of cigarette filters using Olive tree polyphenols, which include hydroxytyrosol and other phenolic compounds. The at least one olive tree polyphenolic compound can include one or more of: hydroxytyrosol, tyrosol oleuropein, homovanillic acid, oleanolic acid, apigenin, luteolin, or elenolic acid. The at least one olive tree polyphenolic compound can belong to one or more of: phenolic acids, flavonoids, stilbenes, lignans, flavonols, flavanols, flavones, flavanones, isoflavones, anthocyanidins, or anthoxanthins.

This invention's object is to provide a filter functionalized with olive tree polyphenols that can reduce the content of amines and nitrosamines in the cigarette smoke and aerosol through the establishment of strong and weak interactions with these compounds. Polyphenols can also cause the reduction in reactive oxygen species production by inhibiting oxidases, decreasing the production of superoxide, inhibiting OxLDL formation, suppressing VSMC proliferation and migration, reducing platelet aggregation, and causing improvement in mitochondrial oxidative stress. The functionalization can include chemical reactions for covalent bond formation between the at least one olive tree polyphenolic compound and a polymer component of the polymer-based the universal filter.

It is further the objective of invention to propose a method, or an approach of a new filter functionalized with olive trees polyphenols, in which the one most present is Hydroxytyrosol, which can be extracted from the leaves or the fruit of olives. The filter that is the subject of this invention is designed to reduce the amines and nitrosamines that are generated during cigarette combustion.

It is also the objective of the invention to provide functionalization of olive tree polyphenols. Polyphenols can be extracted from olive tree leaves and fruits and bears a suitable chemical functionality to cause reactions on filters with toxic chemical compounds. The toxic compounds can include at least one of the compounds belonging to aromatic amines, including but not limited to Aniline, Anisidine, O-Toluidine, 1-Naphthylamine, 2-Naphthylamine, 3-Aminobiphenyl, 4-Aminobiphenyl, or 2,4,6-Trimethylaniline.

Thus, it is the objective to provide a new and improved system of reduction of amines and nitrosamines in cigarette smoke vapors and aerosol through a filter functionalized with polyphenols from the olive tree. Other aspects, advantages, and novel features of the present invention will become apparent from the detailed description when considered in conjunction with the accompanying drawings.

This summary is provided merely to summarize some example embodiments to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to illustrate further embodiments of concepts that include the claimed invention and explain various principles and advantages of those embodiments.

The black spectrum refers to the compounds detected in the cigarette smoke with NC filter.

The red spectrum refers to the compounds detected in the cigarette smoke with PT filter.

Table 1 shows the most significant molecules in which there was diminution of the signal acquired from smoke and aerosols in the PT filter compared with the NC filter as per preferred embodiments of the invention.

Skilled artisans will appreciate those elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Detailed descriptions of the preferred embodiment are provided herein. However, it is to be understood that the present invention may be embodied in various forms. Therefore, specific details disclosed herein are not to be interpreted as limiting but rather as a basis for the claims and as a representative basis for teaching one skilled in the art to employ the present invention in virtually any appropriately detailed system, structure, or manner.

The terminology used herein is to describe particular embodiments only and is not intended to be limiting to the invention. As used herein, "and/or" includes any and all combinations of one or more of the listed items. As used herein, the singular forms "a," "an," and "the" are intended to include the plural forms as well as the singular forms unless the context indicates otherwise. It will be further understood that the terms "comprises" and/or "comprising," when used in this specification, specify the presence of stated features, steps, operations, elements, and/or components but do not preclude the presence or addition of one or more other features, steps, operations, elements, components, and/or groups thereof.

The present invention is directed to provide a new and improved system of reduction of amines and nitrosamines in cigarette smoke vapors through a filter functionalized with polyphenols from the olive tree.

With reference to the drawings, the invention will now be described in detail concerning the best modes and the preferred embodiments.

Figure 1:
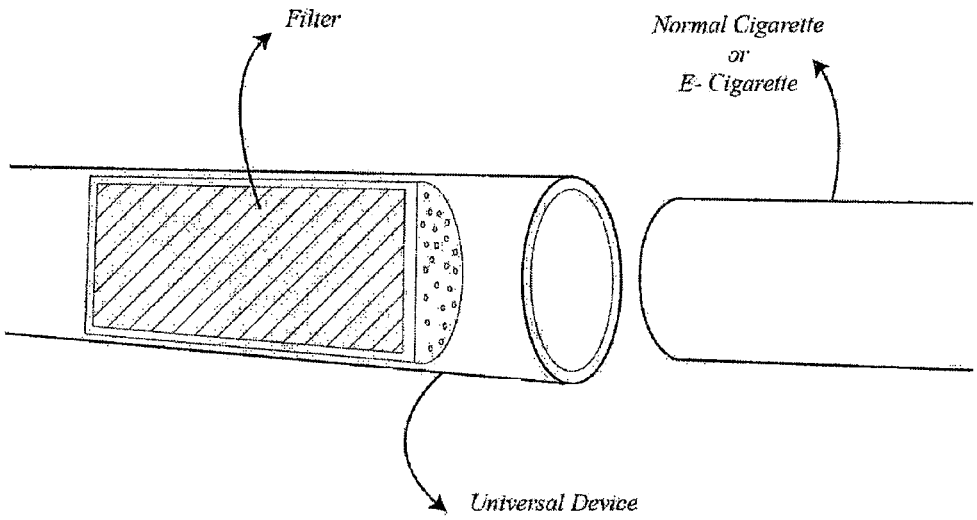
FIG. 1 shows the exploded view of the claimed assembly.
Figure 2:
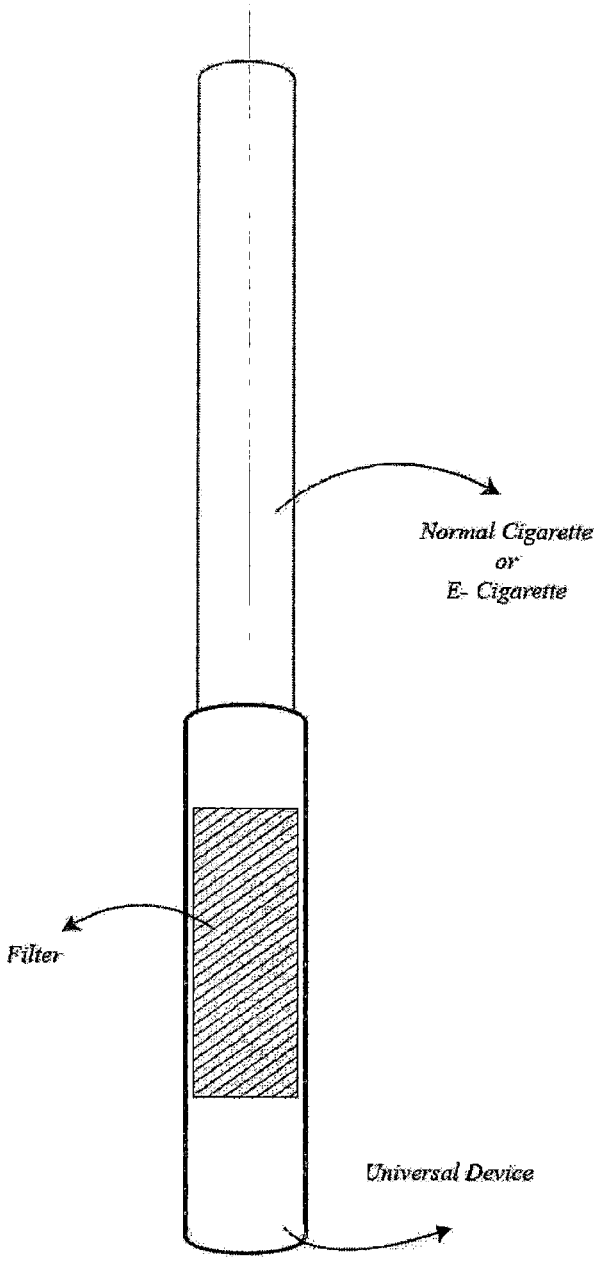
FIG. 2 shows another view of the claimed assembly per preferred embodiments of the invention.
Figure 3A:
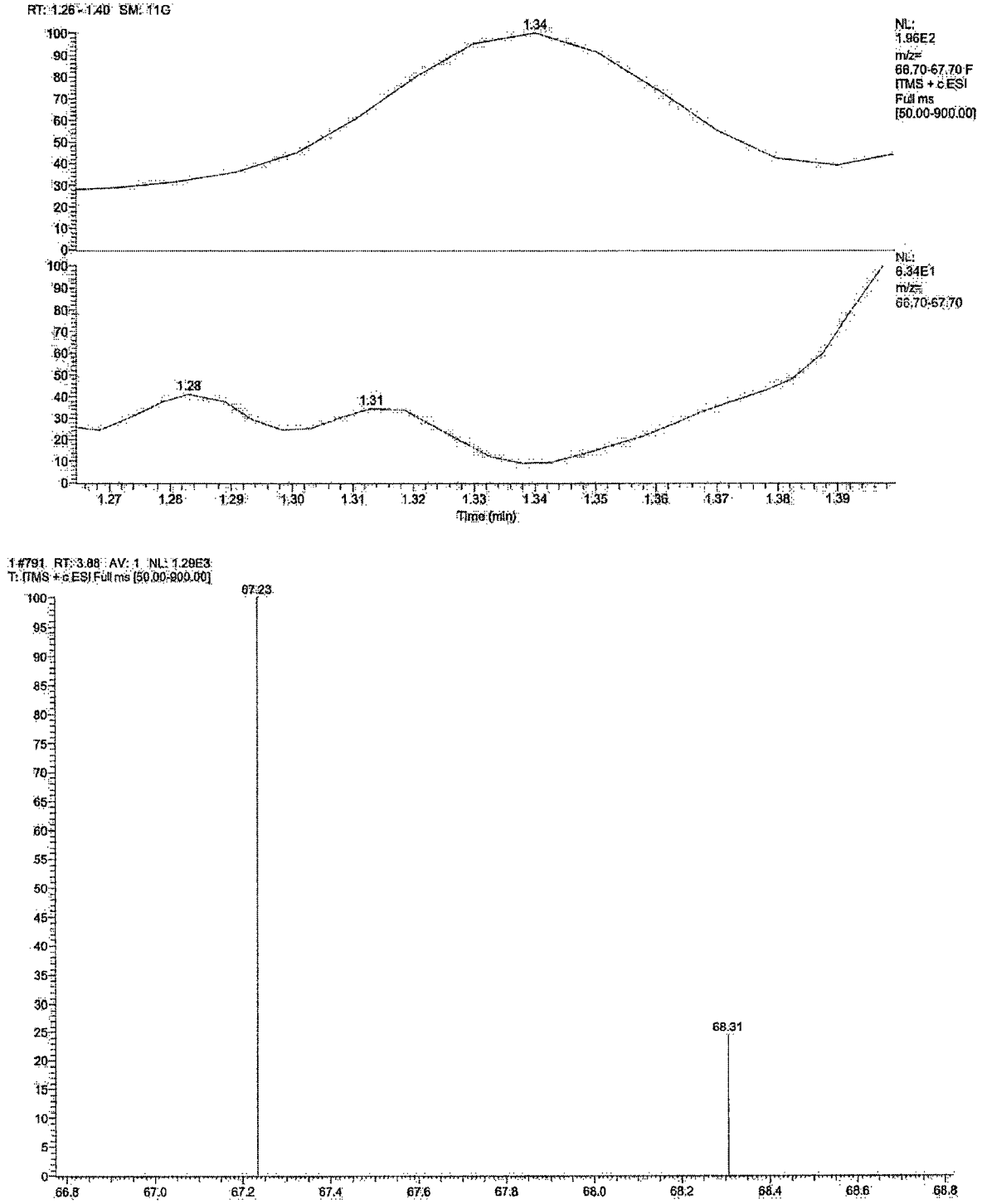
FIG. 3*a-h* C shows the comparative analysis of plots in which the spectra of the detected compounds are.
Figure 3B:
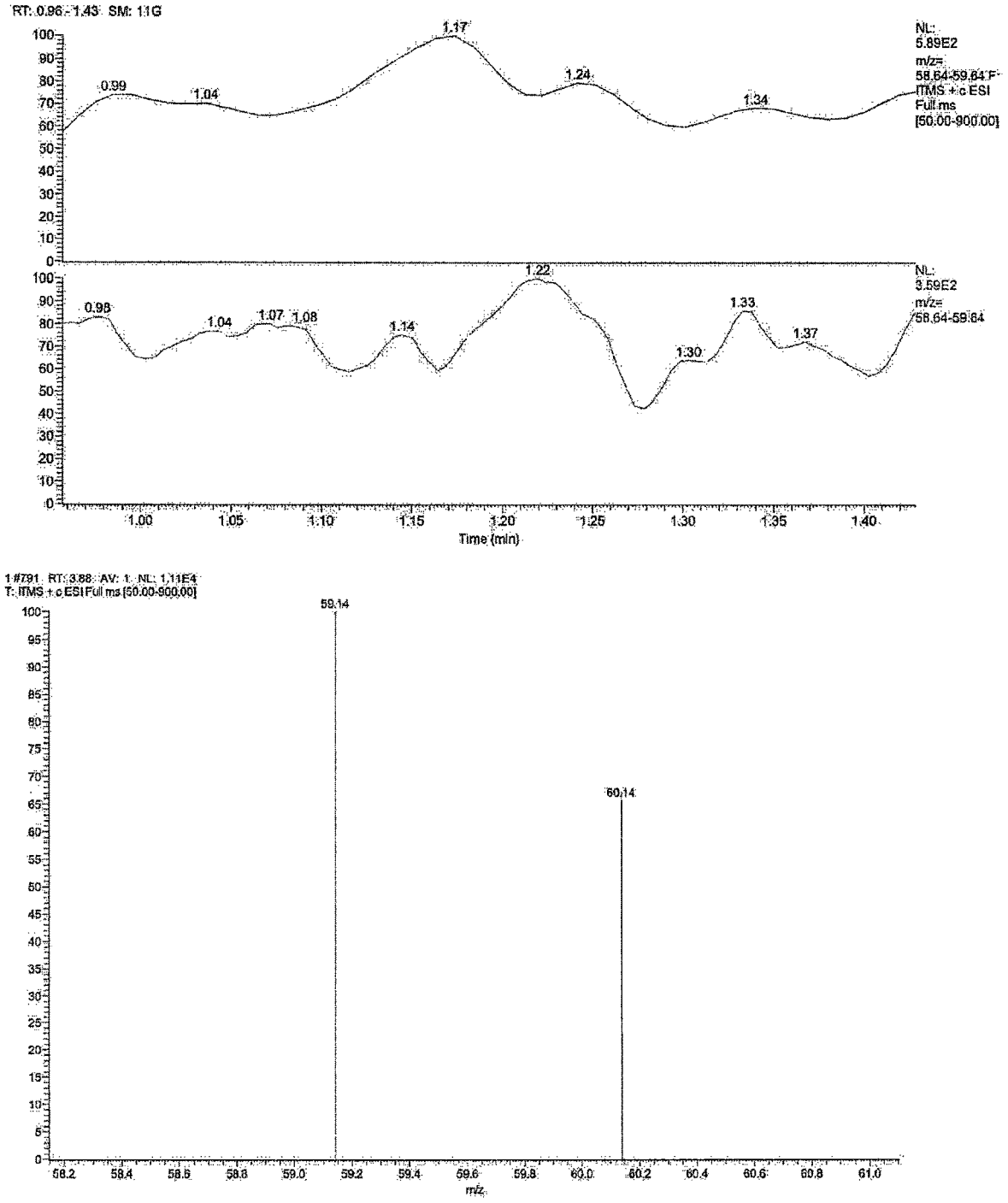
Figure 3C:
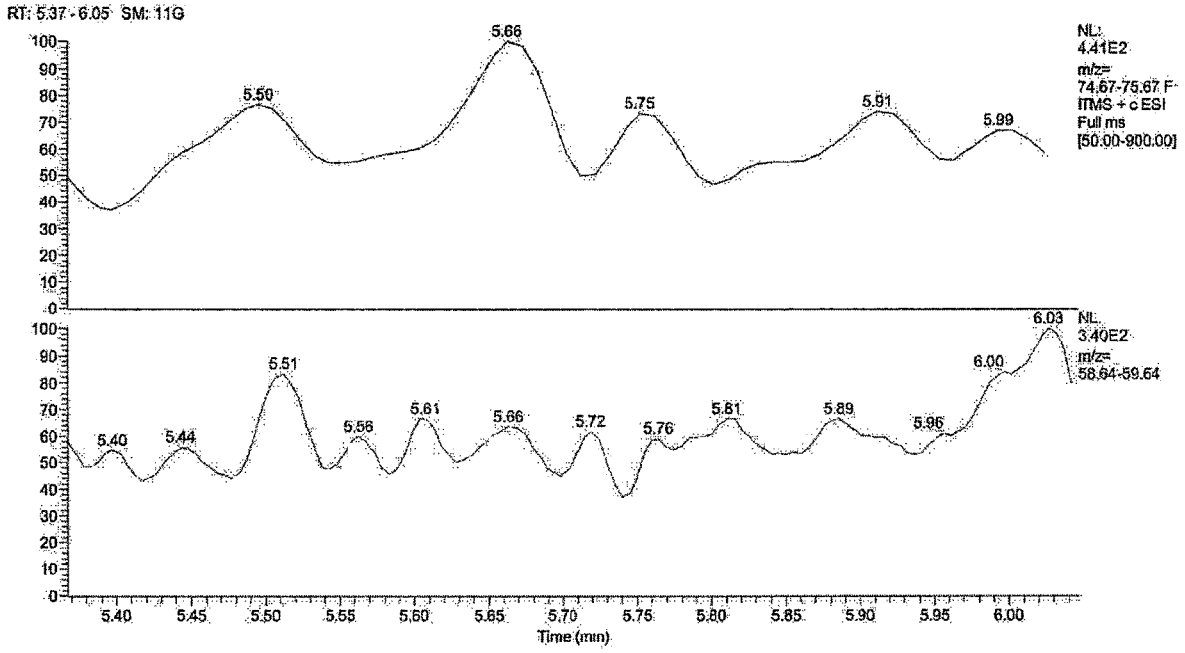
Figure 3C:
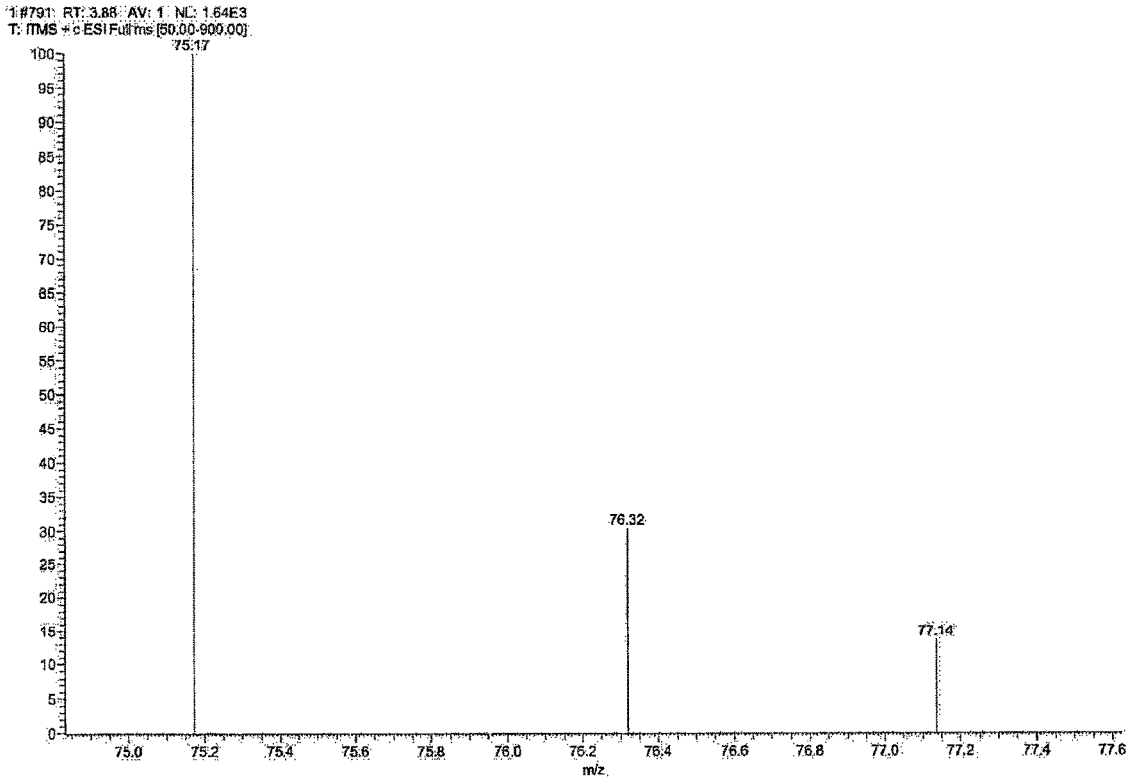
Figure 3D:
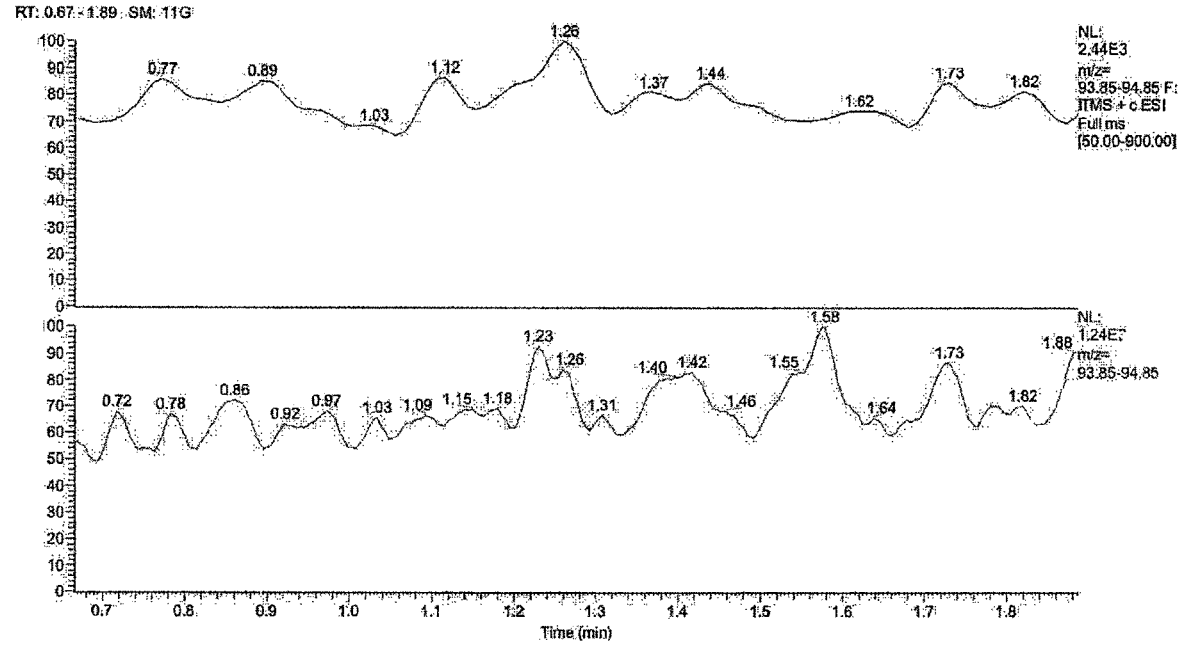
Figure 3D:
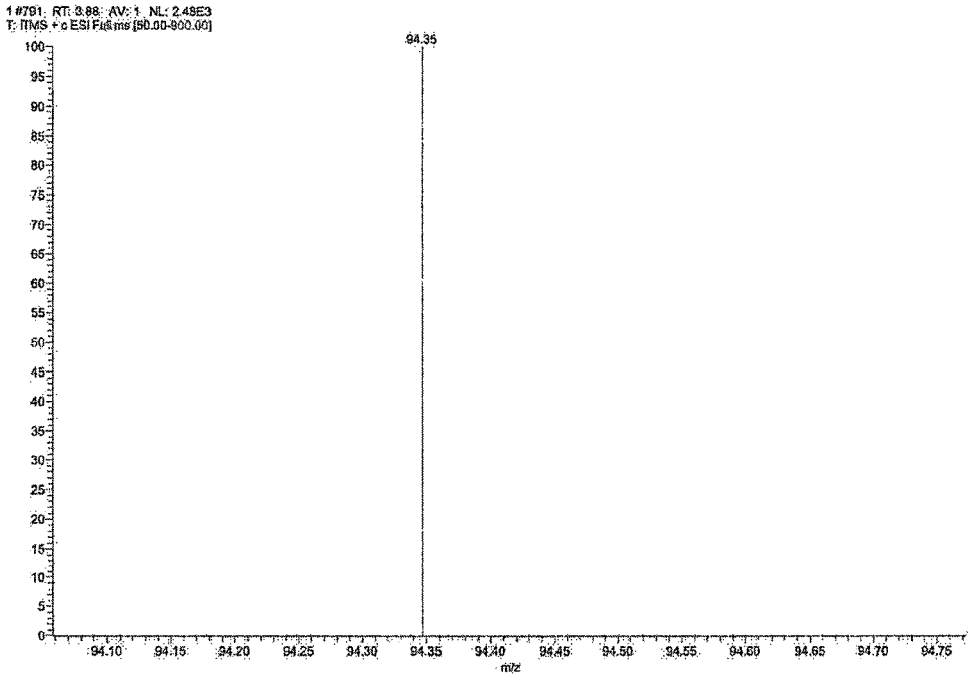
Figure 3E:
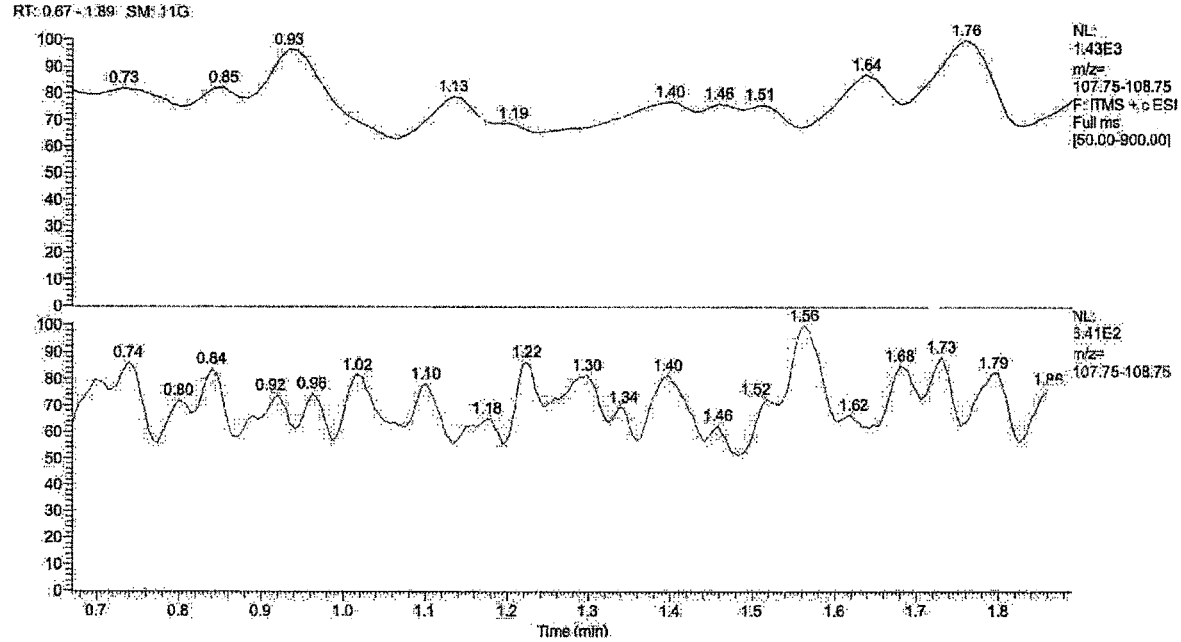
Figure 3E:
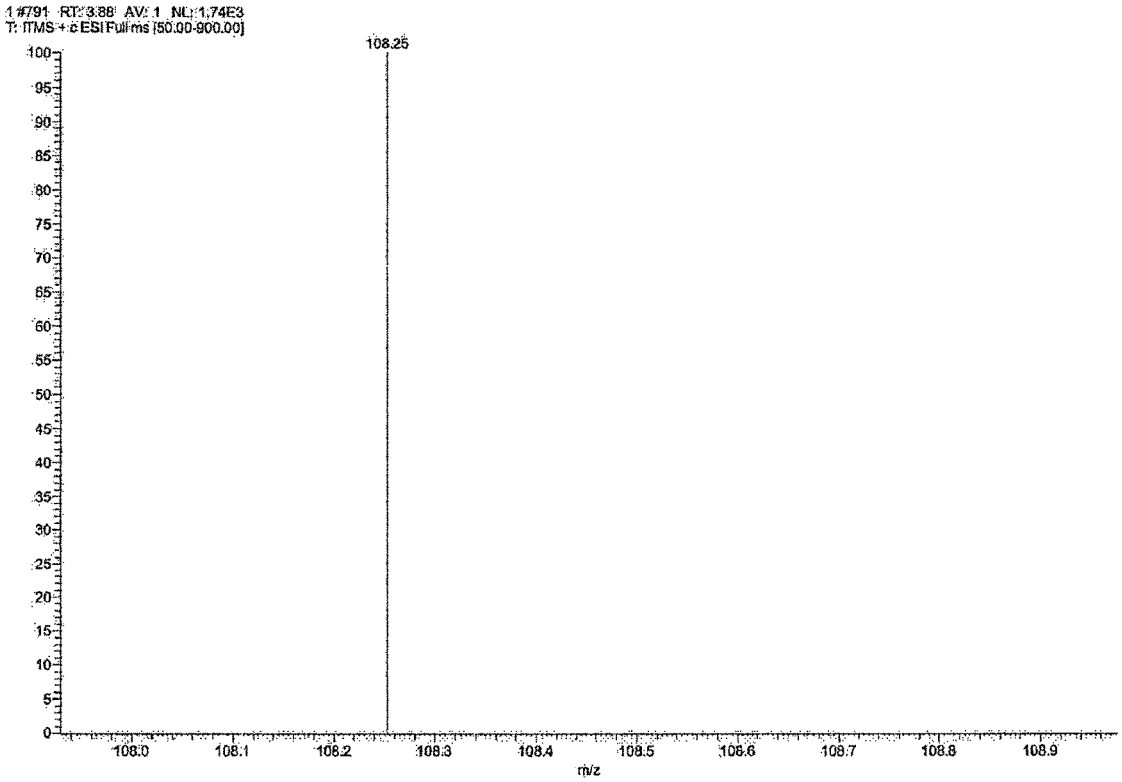
Figure 3F:
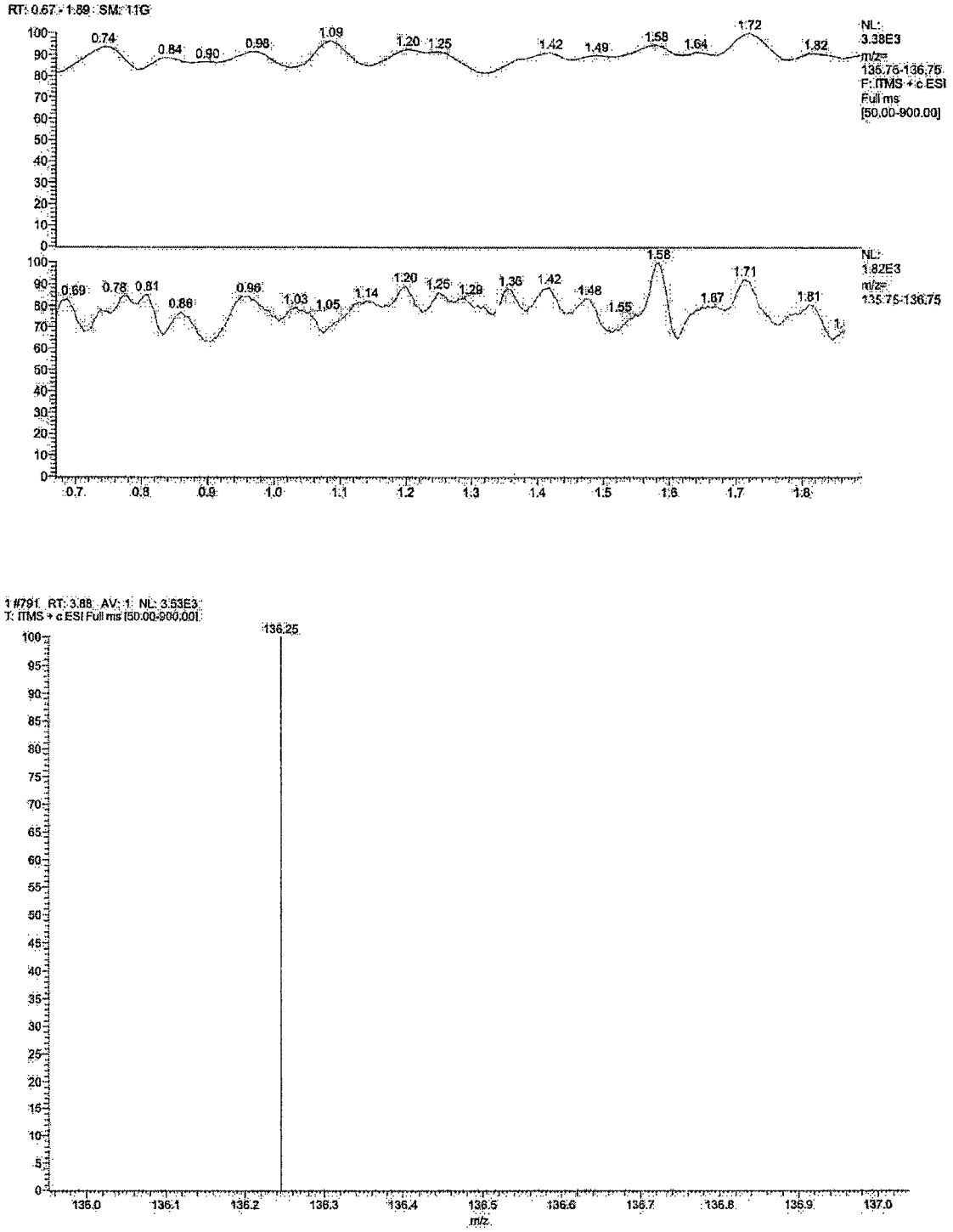
Figure 3G:
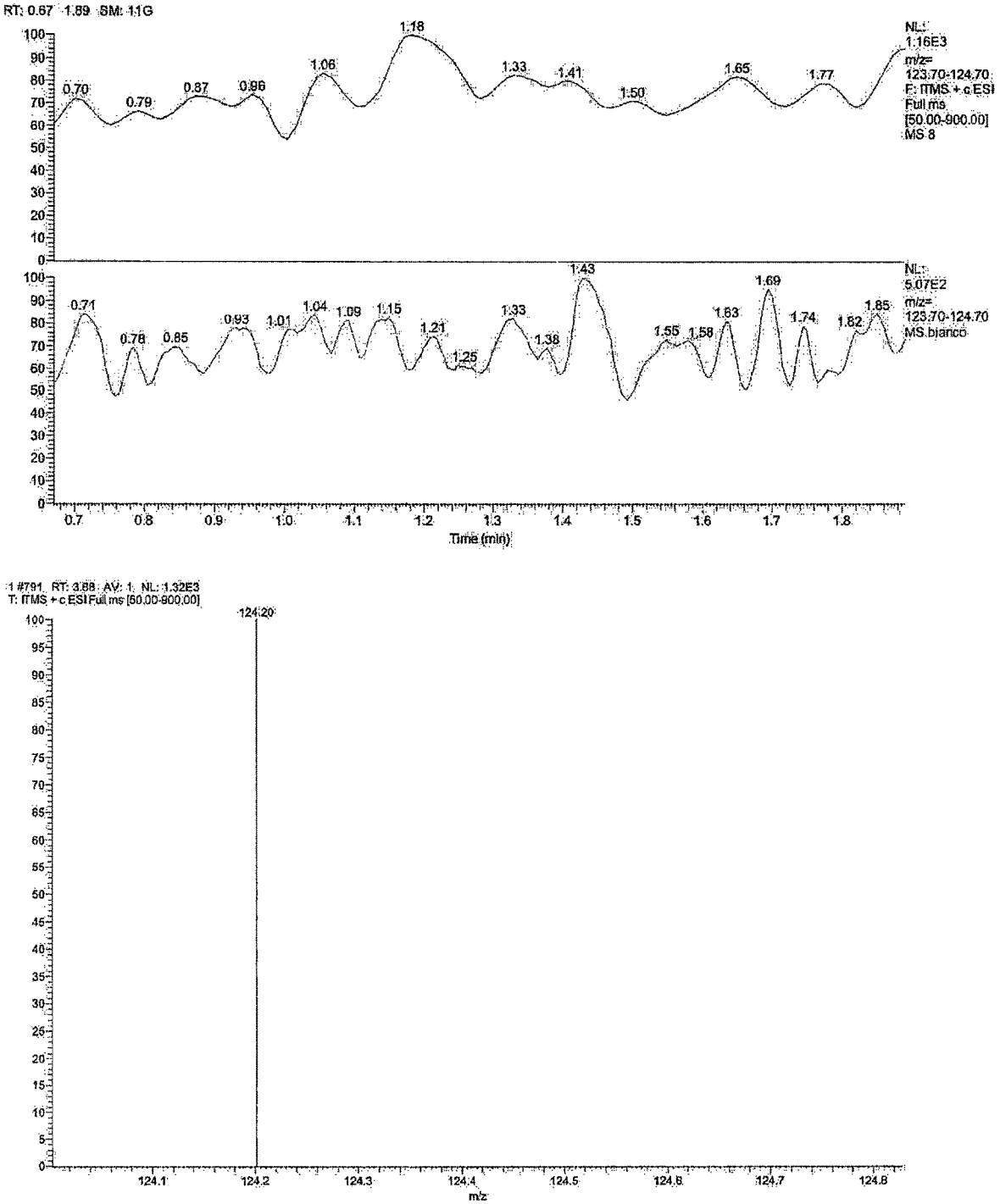
Figure 3H:
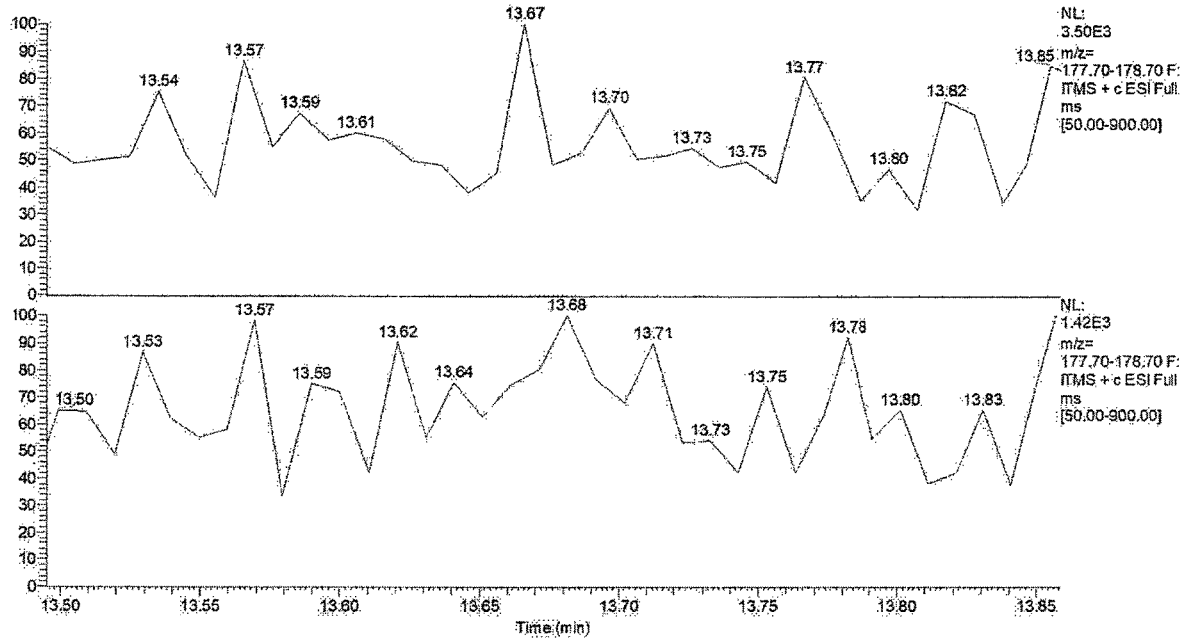
Figure 3H:
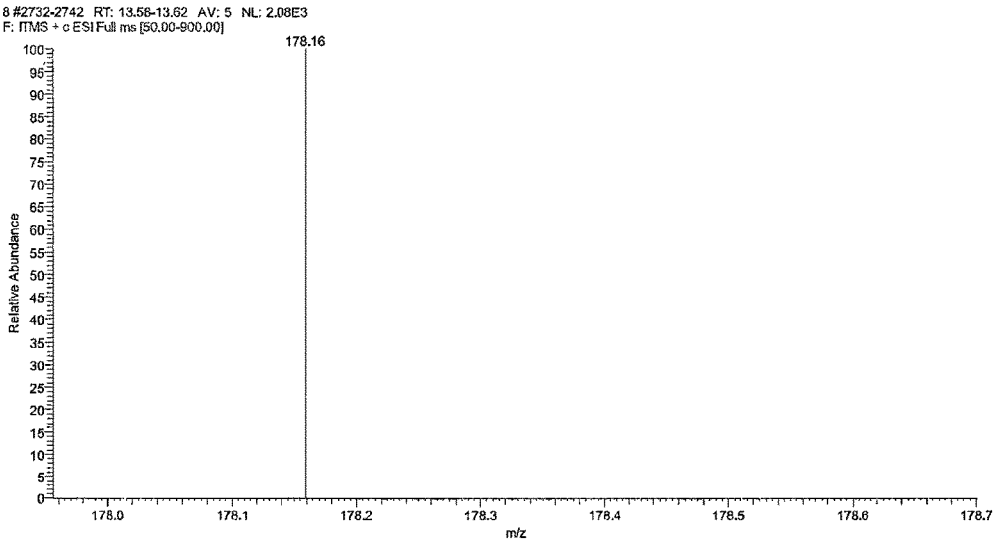

The assembly aims at an alternative approach to improve the function of a traditional cigarette filter by functionalizing the filter using olive tree polyphenols as shown in FIG. 1.

When the chemical properties of polyphenols are observed, the reaction that causes a trap between the electrophilic carbons of either aldehydes or ketones and the catechol group occurs due to an aromatic substitution reaction electrophilic by nature. Furthermore, polyphenols can also react to form strong and weak interactions with amines and nitrosamines, as well as carbonyl groups.

It is unarguably true that the field of filter design has been enriched with numerous valuable contributions from researchers for more than 30 years. Data and findings from the research show that filter ventilation has been misleading smokers, making them think that it makes cigarettes taste milder and lighter (Caroll et al., 2021; Borland et al., 2004; Yong et al., 2011). Secondly, it also develops compensation mainly by providing the idea of taking the larger puffs. Thirdly, for a cigarette that is heavily ventilated (that is, >65% air diluted), blocking of vents with lips or fingers is an additional contributor to compensatory smoking (Kozlowski et al., 2002). Though smokers have such beliefs and advertising claims, filters have significantly less health benefits, and filter tip ventilation can also cause an increase in the health risks caused by smoking (Silva et al., 2021). Despite many modifications in cigarette filters, newer cigarettes with reduced amounts of nicotine and carbon monoxide do not have a lower risk of myocardial infarction than those who smoke cigarettes containing larger quantities of these substances (Kaufman et al., 1983).

Hydroxytyrosol (HXT) or (or 4-(2-di hydroxyphenyl) ethanol) is one of the most powerful extracts, extracted from olive leaves and fruit, that act as a natural antioxidant that lies just below gallic acid (Martinez et al., 2018). The antioxidant functions which it shows have been proved in vitro studies; with intense flavor and aroma, it protects health; and its precursor is oleuropein which is its precursor (Yadav and Singh, 2004; Wang et al., 2013). Several studies have shown that HXT, which is known to be a highly bioactive ortho-diphenol, has interesting antioxidant and antimicrobial characteristics and important beneficial effects on the cardiovascular system and several human diseases (Martinez et al., 2018; Bertelli et al., 2018; Caberizo et al., 2013; Yangui et al., 2009; Leger et al., 2005; Bisignano et al., 1999).

As per further embodiments, Nitrosamines have been seen to be constituents of food, beverage, air, cigarette smoke, cosmetics, and industrial environments, and tobacco-specific nitrosamines are also major compounds present in tobacco which are needed to be studied and reviewed well. (IARC 17 1978; Banbury Report 1982; Magee 1996; Lin 1990; Preussmann and Eisenbrand 1984; Preston-Martin and Correa 1989; Tricker 1997; Magee 1989; Tricker et al. 1989; Startin 1996; Loeppky and Michejda 1984; Eisenbrand et al. 1996; Scanlan 1999;). Tobacco-specific nitrosamines (TSNAs) are a group of carcinogens generated in tobacco smoke. They get produced from nicotine and related alkaloids while processing tobacco and tobacco products. The most common Tobacco specific nitrosamines are: NNN (N'-nitrosonornicotine), NNK ((4-methylnitrosamino)-1-(3-pyridyl)-1-butanone), NAB (N'-nitrosoanabasine) and NAT (N-nitrosoanatabine) (Hoffman et al., 1982). The research conducted on hamster rats showed that NNN and NNK induced tumors in the upper respiratory tract of the rats and that NNK is the most effective and active carcinogen of TSNA that induce adenoma and adenocarcinoma in the human lung. Such harmful effects on the consumer's lungs can also be predicted in humans (Hoffman et al., 1982; Konstantinou et al., 2018; Pool-Zobel et al., 1992; Levy et al., 2004; Arredondo et al., 2006; Ashley et al., 2010). Among nicotine-derived carcinogens, the most important one is nitrosamine is 4-(methylnitrosoamino)-1-(3-pyridyl)-1-butanone (NNK). Secondary reduction of NNK degrades to 4-(methylnitrosoamino)-1-(3-pyridyl)-1-butanol (NNAL), which has an adverse health effect (Matt et al., 2011). So, the invention is needed to reduce such compounds through the functionalization of cigarettes.

The development of the proposed assembly is completed in multiple steps. The first step involves Cellulose acetate for making a filter. The cellulose acetate filters for utilization in cigarette is one of the popular methods of creating a filter. Since cellulose acetate filters are common in cigarettes, the research (Markosyan et al., 1971) is worth studying and discussing. As described, it used fibrous material, staple, calcium chloride, and acetic acid as chemical reagents, stainless steel tube, Teflon capsule, glass joint, heating tube, heater coil, ground-glass joint, glass calibration ampoule, spectrometer, commercial grade triacetate and secondary acetate fibers and equipment for titration.

Discussing the method used in (Markosyan et al., 1971), firstly, fibrous material was cut into pieces, the staple was comped, and placed into an exsiccator over calcium chloride. Stainless steel tube was used to secure one end of the capsule, and another end was provided with a glass joint. An airflow of about 17.5 ml/sec was drawn into the systematic assessment of the sorption power of a fibrous material was done, and the other end of the capsule was used to measure the air resistance. The proportion of the remaining substance in the filter paper was calculated after elution with solvents by spectrophotometric or titrimetric analysis. Fibers were spun to make them wet, having acetic acid as an aqueous bath.

The second step is functional nanocoating over the surface of filters. The research regarding functional nanocoating over the surface of the filter evaluates the application in making commercial cigarette filters (Sadabad et al., 2019). Regarding the reagents and materials, as described, the reagents such as pyrogallol (PG), gallic acid (GA), pyrocatechol (Ctl), epigallocatechin gallate (EGCG), tannic acid (TA), catechin (Ctn), hydroxyhydroquinone (HHQ), caffeic acid (CA), and morin, some of the most common plant-derived phenolic compounds in the presence of sodium ascorbate (SA), glutathione (GSH), and uric acid (UA) as natural antioxidants were used. Phenolic compounds were slowed down in their Kinetics of oxidation value with the help of three naturally occurring antioxidants, including sodium ascorbate (SA), glutathione (GSH), and uric acid (UA). The Kinetics of oxidation of phenolic compounds was slowed down by using three natural antioxidants, including sodium ascorbate (SA), glutathione (GSH), and uric acid (UA).

As per further embodiments, in the study (de Falco et al., 2020) performed for reducing toxic carbonyl species in e-cigarettes, in vitro Reactive Carbonyl Species (RCS) trapping properties of gallic acid, hydroxytyrosol and epigallocatechin were studied based on their chemical structures and also in accordance to their ability to form adducts with glyoxal and methylglyoxal. Glycerol and propylene glycol, 2,4-dinitrophenylhydrazine (DNPH; 4% in phosphoric acid solution), o-phenylenediamine (o-PD), 2,4-dinitrophenylhydrazones of aldehyde/ketone-DNPH stock standard-13 (acetaldehyde-DNPH, acetone-DNPH, acrolein-DNPH, benzaldehyde-DNPH, 2-butanone-DNPH, n-butyraldehyde-DNPH, crotonaldehyde-DNPH, formaldehyde-DNPH, hexaldehyde-DNPH, methacrolein-DNPH, propionaldehyde-DNPH, m-tolu aldehyde-DNPH, valeraldehyde-DNPH), methylglyoxal (40% aqueous solution), glyoxal (40% aqueous solution) and pure polyphenol standard, gallic acid, hydroxytyrosol, and epigallocatechin gallate were obtained from Sigma-Aldrich (St. Louis, MO). Trizma base (Tris-(hydroxymethyl)-aminomethane ACS Reagent Grade), solvents for chromatography analysis, such as acetonitrile, methanol, and water, (liquid chromatography-mass spectrometry, LC-MS grade), as well as acetic acid were purchased from Fisher Scientific (Loughborough, UK).

Disodium hydrogen phosphate and sodium dihydrogen phosphate were purchased from Merck (Darmstadt, Germany). Fibrous four μm silica ("silica wool") was obtained from H. Baumbach & Co Ltd (Suffolk, UK), and Whatman 47 mm QMA silica filters were obtained from Sigma-Aldrich, which were used in the research.

Then, data were taken gravimetrically weighing propylene glycol, glycerol, and water in a ratio of 70:20:10 (w/w/w), and then the model was used in an e-liquid system which was used as a control sample. In Milli-Q water, epigallocatechin, hydroxytyrosol, and gallic acid were prepared at four different concentrations (0.6; 1.25; 2.5 and 5 mM). Then the e-liquid formulation was vortexed for 1 min, sonicated for 3 min to remove bubbles of air, and stored at 4° C. Laboratory vaping and an aerosol collection were then performed using a Subox Mini C device (KangerTech, Shenzhen, China). High-performance liquid chromatography-Ultraviolet (HLPC-UV) analysis of carbonyl compounds was done according to industry standard methods, followed by HLPC-UV analysis of dicarbonyl compounds. Then Liquid chromatography-tandem mass spectrometry (HPLC-ESI-MS/MS) analysis (Honda et al., 2010) was performed, followed by cell culture and cytotoxicity determination.

The process of grafting, was carried out in a glass Petri dish having a diameter of 5 cm with a weight of 50 mg and then in an acidic buffer solution of sodium tartrate buffer (4 cm3, 50 mM and pH=4) having content of Tween 80 at 0.05% (w/v), laccase (>80 Units) and catechin (3.5% w/v) for the measurement of activities and 1% w/v for filtration experiments. Samples were developed at 50° C. at 30 rpm for four h in the dark condition. Then the controlled samples of cellulose were treated under similar conditions without the presence of laccase and polyphenol as their contents were followed by washing of cellulose wipes in distilled water for 2 hours with shaking the contents at 30 rpm, and they have air-dried overnight in a room temperature (Fillat et al., 2012).

The system as per is further embodiments will discuss Sample Preparation. The sample was prepared using commercial cigarette filters. Two filters were used for the experiment:

Polyphenol Treated Filter (PT):

The filter was removed from the commercial cigarette and treated with 500 μL of olive polyphenol solution, titrated to hydroxytyrosol.

Filter Negative Control (NC):

The filter of the commercial cigarette was not treated.

The filters were placed inside a vacuum system, which was connected to an aerosol nebulizer device. The smoke leaving the PT and NC filters was then analyzed using the Secondary Electrospray (SESI) technique, which allows the identification and quantification of volatile organic compounds in the smoke and aerosol.

The results of the smoke analysis were used to evaluate the effects of functionalized olive polyphenols on commercial cigarette filters and to determine any differences in the composition of smoke and aerosol released from PT and NC filters.

The SESI technique was used by setting the aspiration value at 1.2 L/min. The capillary voltage was set at 3 kV. The nebulizer gas value was 5 L/min, and the curtain gas was 1.2 L/min. The solution used to produce the spray was H2O/CH3OH (water/methanol)+0.1% formic acid. The syringe flow rate was 1 μL/min. Data processing was performed using the SANIST-ORBIT platform.

Table 1 shows the most significant molecules in which there was a diminution of the signal acquired from smoke and aerosols in the PT filter compared with the NC filter.

It is contemplated that equivalents and substitutions for certain elements set forth above may be evident to those skilled in the art, and therefore the true scope and definition of the invention is to be as outlined in the following claims.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Instead, it is intended that the appended claims and their equivalents determine the content of this invention.

The Abstract of the Disclosure is provided to allow the reader to ascertain the technical disclosure's nature quickly. It is submitted with the understanding that it will not be used to interpret or limit the scope or meaning of the claims. In addition, in the foregoing Detailed Description, it can be seen that various features are grouped in various embodiments to streamline the disclosure. This method of disclosure is not to be interpreted as reflecting an intention that the claimed embodiments require more features than are expressly recited in each claim. Instead, as the following claims reflect, the inventive subject matter is less than all features of a disclosed embodiment. Thus, the following claims are incorporated into the Detailed Description, with each claim standing on its own as a separately claimed subject matter.

INDUSTRIAL APPLICATION

The industrial utility of the invention is in cigarette filter manufacturing. The technology proposed herein encompasses a universal filter, enhanced with olive tree polyphenols, specifically designed to entrap toxic compounds such as amines and nitrosamines found in cigarette smoke. This innovative approach offers a novel mechanism to render cigarette smoking less harmful, by significantly reducing the smoker's exposure to these hazardous substances. Potential adopters of this technology could include tobacco manufacturers seeking to improve the safety profile of their products, and manufacturers of smoking accessories interested in providing healthier alternatives to conventional cigarette filters.

What is claimed is:

1. A polymer-based universal filter for cigarettes and/or vaping devices, the polymer-based universal filter comprising an inhibitor to inhibit the formation of toxic reactive compounds within the cigarette and/or in the aerosol formed by it, the inhibitor includes at least one olive tree polyphenolic compound, functionalized to the universal filter, and the functionalization includes chemical reactions for covalent bond formation between the at least one olive tree polyphenolic compound and a polymer component of the polymer-based the universal filter.

2. The filter according to claim 1, wherein the toxic compounds include at least one of the compounds belonging to aromatic amines, including but not limited to Aniline, Anisidine, O-Toluidine, 1-Naphthylamine, 2-Naphthylamine, 3-Aminobiphenyl, 4-Aminobiphenyl, 2,4,6-Trimethylaniline.

3. A filter according to claim 1, wherein the toxic compounds include at least one of the compounds belonging to nitrosamines, including but not limited to NNN (N'-nitrosonornicotine), NNK ((4-methylnitrosamino)-1-(3-pyridyl)-1-butanone), NAB (N'-nitrosoanabasine), or NAT (N-nitrosoanatabine).

4. A filter according to claim 1, wherein the at least one olive tree polyphenolic compound includes one or more of: hydroxytyrosol, tyrosol, oleuropein, homovanillic acid, oleanolic acid, apigenin, luteolin, or elenolic acid.

5. A filter according to claim 1, wherein the at least one olive tree polyphenolic compound, belonging to phenolic acids, flavonoids, stilbenes, lignans, flavonols, flavanols, flavones, flavanones, isoflavones, anthocyanidins, and anthoxanthins.

6. The filter according to claim 1, wherein the filter is adapted to be used as a universal device in the cigarette or to be attached to the cigarette and/or to the vaping devices.

7. The filter according to claim 1, wherein the at least one olive tree polyphenolic compound is grafted to the polymer-based universal filter.

* * * * *